United States Patent [101]

Mancini et al.

[11] 4,052,828

[45] Oct. 11, 1977

[54] STRUCTURAL MEMBER

[76] Inventors: Robert Mancini, 8 Stepheny Drive, Toronto, Ontario M8W 2N5; Vincenzo Gentile, 94 Bowie Ave., Toronto, Ontario M6E 2P7, both of Canada

[21] Appl. No.: 533,147

[22] Filed: Dec. 16, 1974

[51] Int. Cl.[2] ..... E04F 19/04

[52] U.S. Cl. ..... 52/242; 52/290; 52/618

[58] Field of Search ..... 52/241, 242, 290, 618, 52/265

[56] References Cited

U.S. PATENT DOCUMENTS

| | | | |
|---|---|---|---|
| 2,078,491 | 4/1937 | Graham | 52/241 |
| 3,017,672 | 1/1962 | Vaughan | 52/241 |
| 3,112,532 | 12/1963 | Slowinski | 52/618 |
| 3,327,448 | 6/1967 | Lincoln | 52/241 |
| 3,872,633 | 3/1975 | Altosaar | 52/242 |

FOREIGN PATENT DOCUMENTS

| | | | |
|---|---|---|---|
| 911,063 | 6/1946 | France | 52/618 |
| 580,623 | 9/1946 | United Kingdom | 52/241 |
| 540,302 | 10/1941 | United Kingdom | 52/241 |

*Primary Examiner*—Price C. Faw, Jr.

*Assistant Examiner*—Henry Raduazo

[57] ABSTRACT

A wall is provided between a ceiling and floor, such wall comprising outer dry wall boards sandwiching a corrugated cardboard core. Supporting the wall at its upper end adjacent the ceiling is an inverted U-channel. Supporting the wall at its lower end is a support comprising two components, one of which is fastened to the floor by nailing. The other component is inserted under an edge of the first component to support the wall panel therebetween.

7 Claims, 14 Drawing Figures

12
20
26
28
34
40
44
46
48
49
50
52
53
54
56
57
58
59
60
61
62
63
64
66
68
70
72

STRUCTURAL MEMBER

Field of the Invention

This invention relates to structural members and the method of their manufacture.

BACKGROUND OF THE INVENTION

Industry has long sought a structural member having wide application, considerable structural strength and rigidity and good acoustic and insulating properties; yet which is both easily and economically manufactured.

In particular, in the usual method of manufacture of the interior walls of houses, studs are spaced every sixteen inches and dry wall is nailed on either side of the studs to form the partition between adjacent rooms or hallways. However, such partition as such has poor insulating and acoustic properties. Moreover, because the wall is wholly manufactured on the job site, labour costs are substantially increased.

Where also, for example, office partitioning is necessary, to provide temporary office space, such partitioning is provided either as, with houses, by the erection of permanent walls by the method outlined above or by the use of a temporary system utilizing partitions having, for example, a horizontally disposed honey comb, or a solid, core construction. Both, however, are very expensive to manufacture and where heating or plumbing fixtures or electrical wiring must be provided, additional specialized modifications must be made in each to accommodate same.

It is therefore, an object of this invention to provide structural members, having good acoustical and insulating properties, considerable structural strength and rigidity, which are both easily and economically manufactured and for a process for the manufacture thereof.

It is a further object of the invention to provide a system for mounting such structural members when said members are mounted vertically.

Further and other features and advantages of the invention will be realized by those skilled in the art from the following summary of the invention and more detailed description thereof.

SUMMARY OF THE INVENTION

According to one important aspect of the invention, a structural member according to the invention comprises two sheets of material sandwiching a corrugated core.

According to one important aspect of the invention, a structural member according to the invention comprises two sheets of material sandwiching a corrugated core.

According to another aspect of the invention the cross-section of the corrugated core looking vertically downwardly on the core of member as erected is in the form of "V's" joined one to the other.

According to another aspect of the invention, the sheets of material may comprise gypsum or dry wall and the corrugated core may, itself, comprise triple faced double corrugated sheets of cardboard which cardboard may have been appropriately treated to further enhance the physical characteristics of that member as, for example, by water or fire proofing.

According to another aspect of the invention, when the structural member comprises dry wall and corrugated cardboard, such member may be manufactured by a. Alternately longitudinally cutting the upper and lower surfaces of the sheets of cardboard, preferably being triple faced double corrugated cardboard, at predetermined equidistantly spaced intervals, bending or folding the cardboard from the surface opposite the surface in which the cut was made, generally towards the cut, and b. securing sheets of dry wall on the top and bottom of the folded cardboard at the cuts therein.

According to another aspect of the invention, when the sheets of material and the corrugated core of the structural member comprise a metal preferably steel sheet metal, such member may be manufactured by a. folding or corrugating the core material and b. securing the outer metal sheets on the top and bottom of the corrugated core material.

According to another aspect of the invention, when the sheets of material and the corrugated core of the structural member comprise a plastic or polymeric material, such member may be manufactured by a. vacuum forming the corrugated core member and b. securing the outer sheets on the top and bottom of the corrugated core material.

According to another aspect of the invention when the structural member comprises a plastic or polymeric material, the member may be extruded.

According to another aspect of the invention, when the structural member is used to form a partition, the upper end may be maintained in a downwardly facing U-channel secured to the ceiling structure and the lower end, supported by a unique two component support mounted on the floor which support comprises first and second components the first component being secured to the floor, each component having a generally vertically extending portion when mounted, and a generally horizontally extending portion having supporting means, preferably a crimp a predetermined distance from the juncture of the vertically and horizontally extending portions and means to engage and secure the two components together. Preferably the generally horizontally extending portion of the first component, on the side of the crimp remote the juncture, slopes upwardly and preferably each component has on the side of the crimp remote from such juncture, resilient ramp means, sloping upwardly away from the crimp in the first component, and upwardly towards the crimp from adjacent the end of the horizontal portion remote the juncture of the horizontal and vertical portion, in the second component, the ramp means being adapted to be secured together and preferably being adapted to overlie one another when the member is mounted until the member is raised, whereby the resilient ramp means of the first component springs upwardly to permit the ramp means of the second component to be dislodged from under the ramp means in the first component.

DETAILED DESCRIPTION OF PREFERRED EMBODIMENTS OF THE INVENTION

Figure 1:
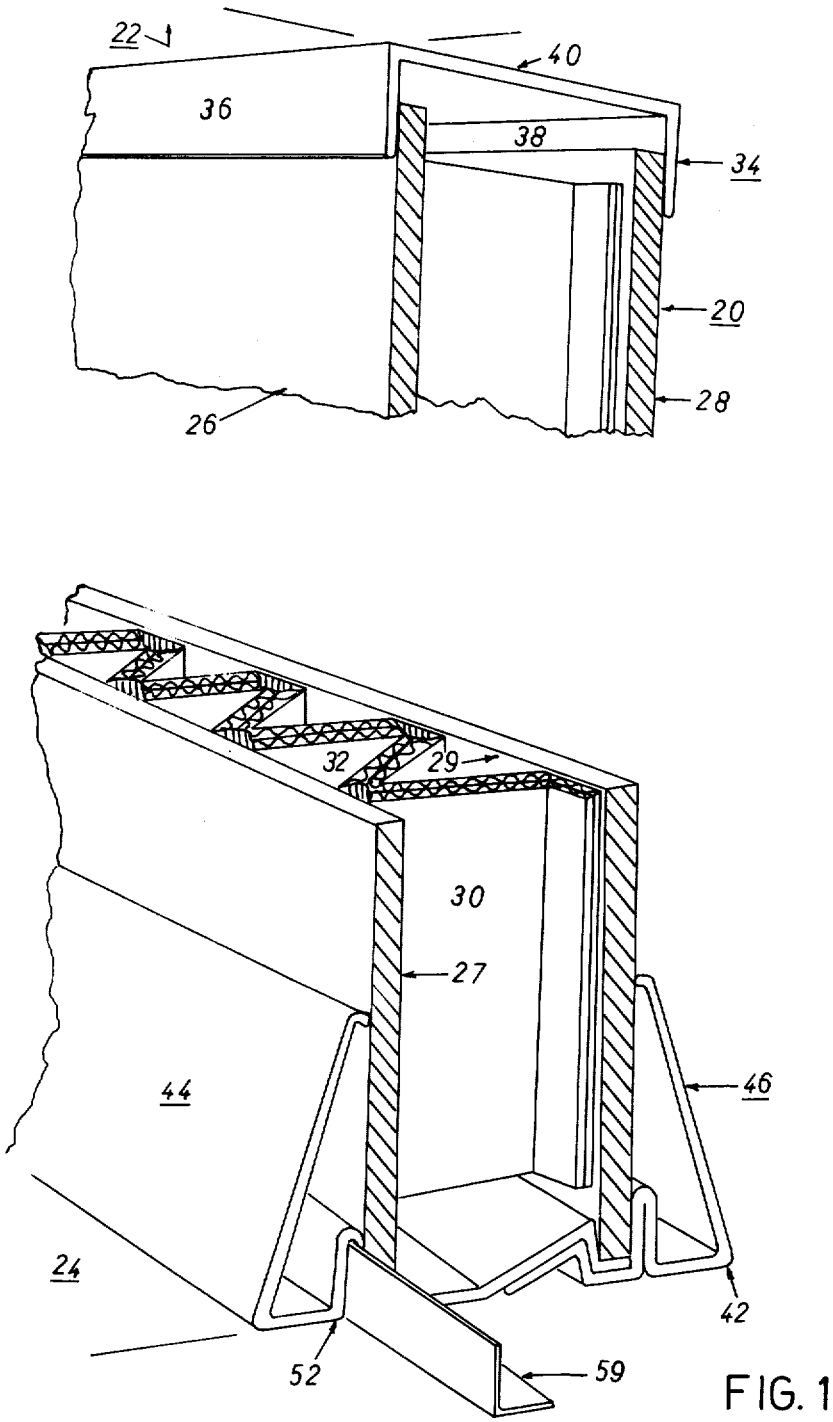
FIG. 1 is a perspective view, partly in section of a wall, constructed and secured in accordance with a preferred embodiment of the invention.

Referring to FIG. 1, there is provided a wall structure or partition 20, mounted and secured between ceiling 22 and floor 24, comprising outer dry wall boards 26 and 28, sandwiching a corrugated triple faced double corrugated cardboard core 30, extending vertically within the wall, so that triangular openings 32 formed between either of the inner surface walls 27 and 29 of the wall boards 26 and 28 respectively and corrugated cardboard core 30, extend generally vertically. Corrugated core 30 does not extend to the bottom of the boards 26 and 28 adjacent the floor but ends short thereof for the purposes of mounting the wall structure.

Supporting the wall at its upper end adjacent the ceiling is inverted U-channel 34 of a width greater than the thickness of member 20 comprising side walls 36 and 38 and channel top 40. When supported in U-channel 34, the top of wall 20 is spaced from channel top 40.

Support for wall 20 at its lower end, is provided by support 42 comprising two components, a first component 44 and a second component 46 which may comprise plastic or metal, extruded or rolled, in the desired configuration.

Figures 2, 3, 4:
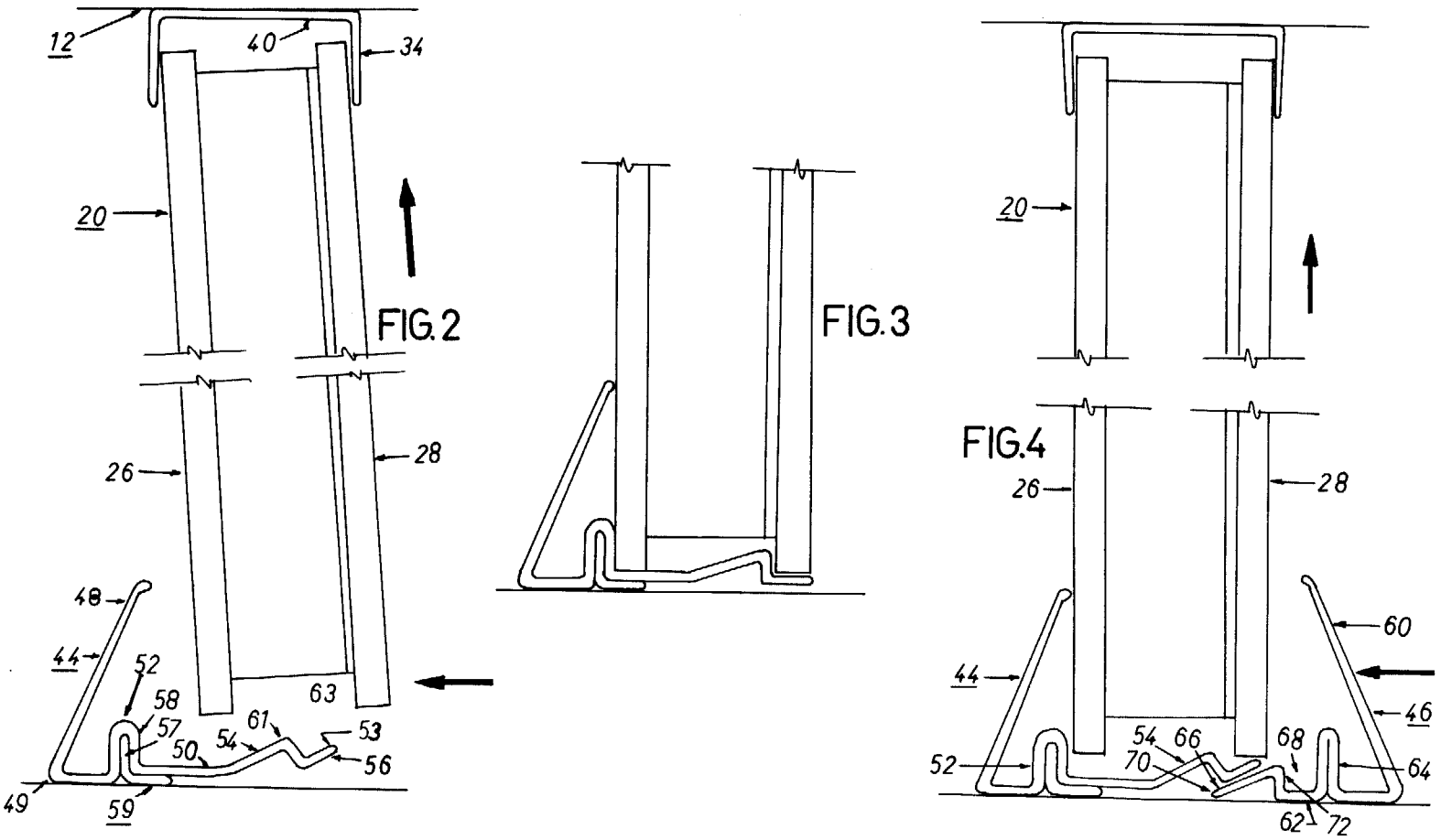
FIGS. 2, 3 and 4 are end views of the wall according to FIG. 1 and illustrate step by step a method of securing the wall using unique lower supporting means, all according to a preferred embodiment of the invention.

First component 44 seen best in FIG. 2, is an integral unit and comprises generally vertically extending portion 48 sloping inwardly toward board 26 at its upper end and generally horizontal portion 50 meeting vertical portion 48 at 49 and includes a crimp 52 and resilient ramp 54 intermediate the two ends 49 and 53, the distance between the inner edge 58 of crimp 52 and the ramp edge 61 remote crimp 52 when the generally horizontal portion 50 lies substantially flat on the floor, being the distance between the outer surface of board 26 and the inner surface of board 28. Note that the portion of generally horizontal portion 50 between ramp 54 and end 56 is resilient and is disposed sloping upwardly for the purposes hereinafter discussed. Securing component 44 to the floor, a nail may be driven through the horizontal portion 50 or an L-shaped aligner support, secured to the floor, may be mounted to seat in crimp 52, shown best in FIG. 1 and in side view in FIG. 2, at 59.

Second component 46 seen best in FIG. 4 also is an integral unit and comprises a generally vertically extending portion 60, sloping inwardly toward board 28 at its upper end and horizontal portion 62 including crimp 64 and ramp 66, the end 70 of ramp 66 furthest from crimp 64 also being the end of the horizontal portion and being in the same plane as portion 68 of horizontal portion 62.

When wall 20 is mounted, component 46 is secured under component 44 and ramp 66 lies directly under ramp 54, seen best in FIG. 4. Thus the distance between the inner end of crimp 64 and end 72 of ramp 66 closest crimp 64, is the thickness of board 28. Thus the distance between the inner edges of crimps 52 and 64 is equal to the width of wall 20 when support 46 is secured under support 44.

Referring to FIGS. 2, 3 and 4, wall 20 is secured into position as follows:

Channel 34 is secured to ceiling 12 and aligner 59 nailed to the floor. Component 44 is secured to the floor over aligner 59 such that the upwardly extending portion 57 extends into crimp 52 and/or horizontal portion 50 fastened to the floor as by nailing.

Wall 20 is then angled relative to channel 34, the upper end inserted therein to abut the top 40, the lower end swung into position and vertically aligned and lowered to abut crimp 52. Thus ramp 54 and 56 portion are pushed downwardly to contact the floor with the result that end 61 of ramp 54 remote from crimp 52 abuts the interior surface of board 28. Thus it will be seen that wall 20 does not extend the full length from floor to ceiling but rather is shorter to permit the mounting of same. Component 46 is secured to component 44 to support wall 54 by lifting wall 20 to permit the upward springing of ramp 20 and end 53 and by positioning ramp 66 under ramp 54 so that the outer surface of board 28 abuts crimp 64 when wall 20 is lowered. When wall 20 is lowered, portion 56 is pressed parallel to floor 24 and ramp 54 overlies ramp 66.

To disassemble the structure, wall member 20 is raised, thus permitting resilient ramp 54 and portion 56 to spring upwardly to permit ramp 66 of the second component to be withdrawn from under ramp 54.

Figure 10:
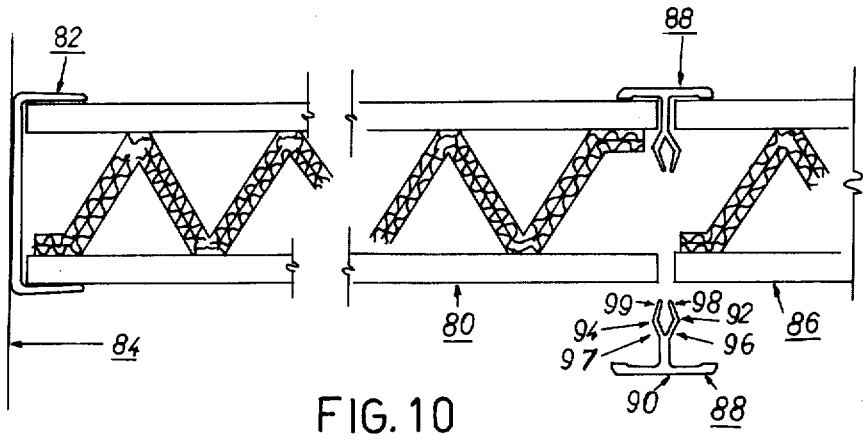
FIG. 10 is a top view illustrating the means of joining two walls or partitions, one wall or partition being secured to a permanent structure, according to a preferred embodiment of the invention.
Figure 11:
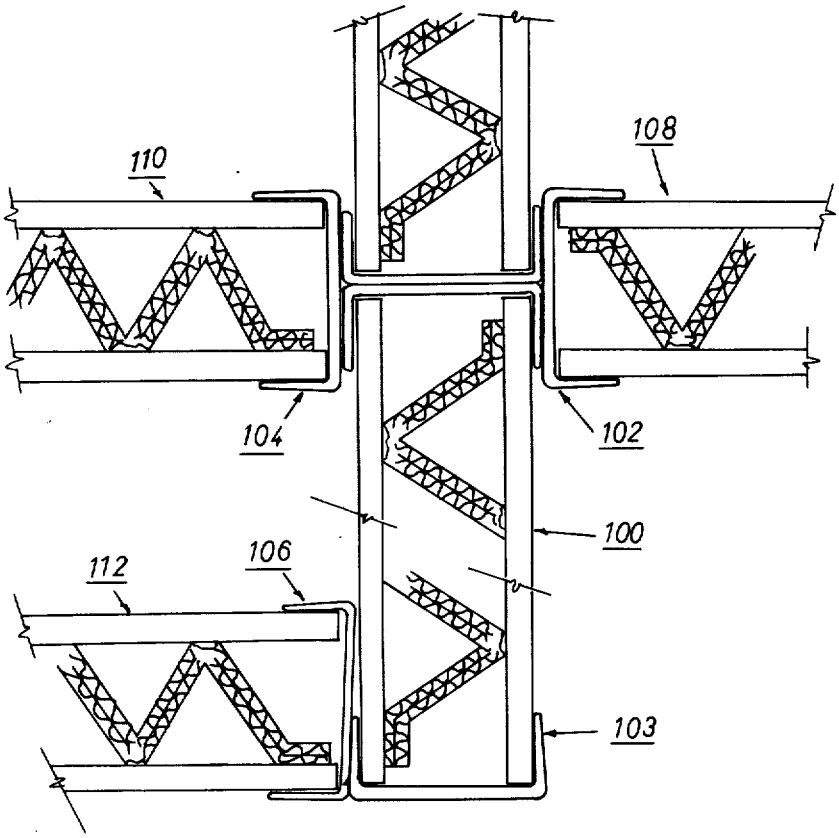
FIG. 11 is a top view of a group of walls or partitions secured to one another according to a preferred embodiment of the invention.
Figure 14:
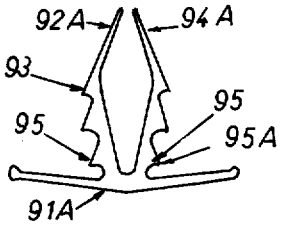
FIG. 14 illustrates an alternate batten useful in joining several walls as in FIGS. 10 and 11.

This wall structure may then be combined with others to form longer wall formations or partitions to divide a given area into various rooms or offices. For example, FIGS. 10 and 11 illustrate two walls joined to form a longer wall and, the formation of corners by the meeting of a plurality of walls employing vertical channels for mounting purposes, respectively. Aligner 59 secures longitudinally adjacent first components 44 when more than one support is required to mount a plurality of such wall structures (not shown). Referring to FIG. 10 wall 80 is provided, secured in vertical channel 82 secured to permanent structural wall 84. Wall 86 is secured to longitudinally adjacent wall 80 and battens 88 are pushed into the space therebetween. Each batten in cross-section comprises 'T' portion 90 at its upper end, from which extends prongs 92 and 94 which diverge from 'T' portion 90 for a predetermined distance to form portions 96 and 97 and then converge to form portions 98 and 99. On portions 96, 97, 98 and 99 being pushed between the adjacent walls, portions 96 and 98 are forced towards portions 97 and 99 and once interior of the wall boards 80 and 86, rebound to their original relative positions to one another. Thus the joints between adjacent walls are covered. An alternate structure of a batten useful for the purposes of this invention is illustrated in FIG. 14 and has prongs 92A and 94A extending from top 91A, each prong having rearwardly sloped spikes 93 which, when this batten is pushed into the space between adjoining walls, abut the inner surface of the wall boards on the surface of the spike closer to top 91A as at 95 and points 95A of spikes 93 abut adjacent edges of wallboards 80 and 86 to secure batten in position.

Referring to FIG. 11, wall 100 is provided to which is fastened vertical channels 102, 103, 104 and 106 into which walls 108, 110 and 112 are secured so as to illustrate the formation of corners.

Figure 12:
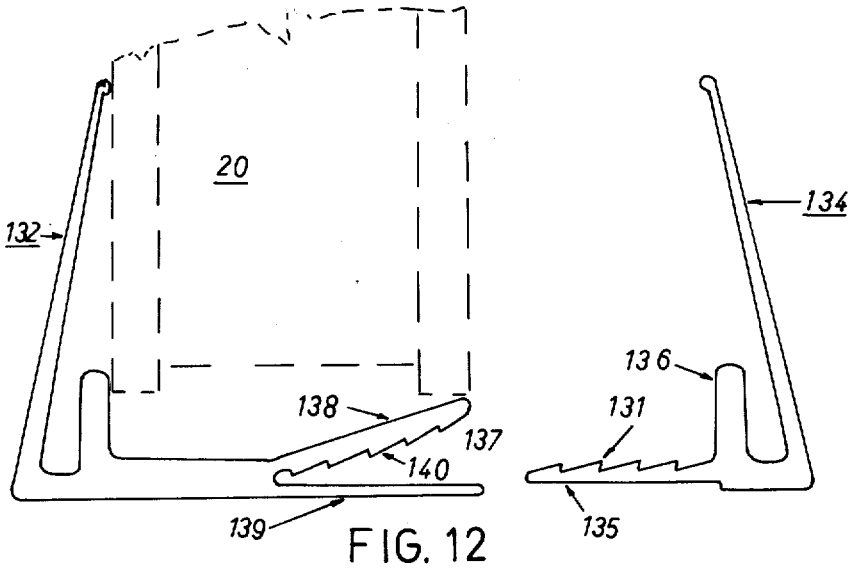
FIGS. 12 and 13 illustrate alternate floor supports for the wall according to a further preferred embodiment of the invention.
Figure 13:
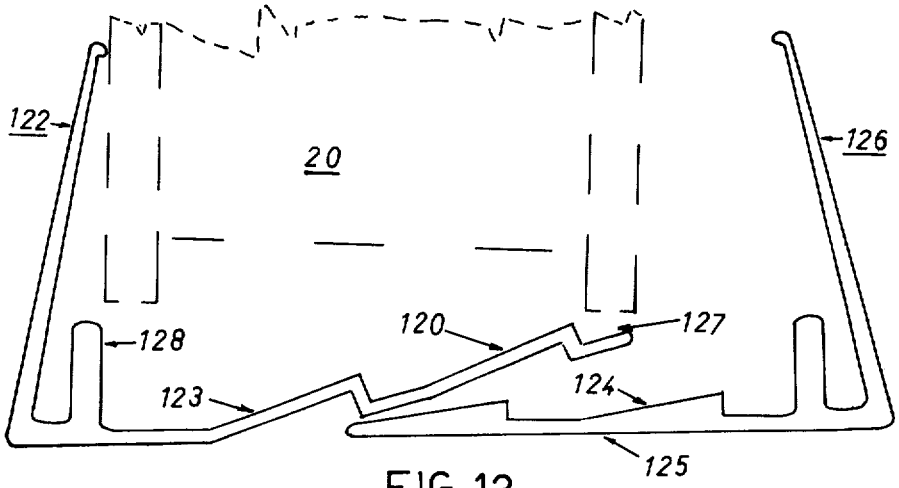

Modifications may also be made to the structural supports 44 and 46. For example, alternate useful structures are shown in FIGS. 12 and 13. FIG. 13, for example, shows a plurality of resilient ramps 120 of member 122 to overlie ramps 124 on extension 125 of member 126 when wall 20 is seated on generally horizontal portions 123 and 127, otherwise portion 123 slopes upwardly away from the crimp 128. FIG. 12 illustrates an alternate method of joining the two support members 132 and 134 wherein an extension 135 is provided on member 134 a predetermined distance above the lower most portion of member 134 and has a plurality of upwardly extending teeth 131 tapering away from crimp 136 to be received in mouth 137 of member 132 having resilient diverging jaw 138 sloping upwardly from horizontally disposed jaw 139, mouth 137 having an internal configuration to receive and secure the teeth 131 in cavities 140 of jaw 138 when wall 20 seats on jaw 138, thereby locking supports 132 and 134 together until wall 20 is raised to permit the upspringing of resilient jaw 138 to permit withdrawal of extension 135.

Therefore, a structural member is provided with components for securing same between the ceiling and floor, which are useful to construct rooms or partitions. The benefits of the use of such member are many because of its structure.

For example, sound pressure waves impinging on the outer surface of the structural member are partially reflected to be of no consequence, or transmitted into the core. Due to the geometry of the core, the waves transmitted to the core are then subjected to numerous reflections within the voids thus losing energy. When the corrugated core comprises triple faced double corrugated cardboard, the corrugations in the corrugated core also reduces the energy of the sound wave. Of course it is also readily apparent to increase the already satisfactory acoustic properties, the voids between the adjacent "V's" may be filled with insulation and/or the outer surfaces may be perforated to produce resonant chambers out of the said voids. A further feature of the core lies in its ability to stiffen the wall. Additionally, the wall members act as good insulators in that where a temperature difference exists between the two outer boards, the core increases the thermal resistance of the structural member. Once again the voids may be filled. These members may be further strengthened by the addition of struts disposed on at least one side thereof.

Figure 5:
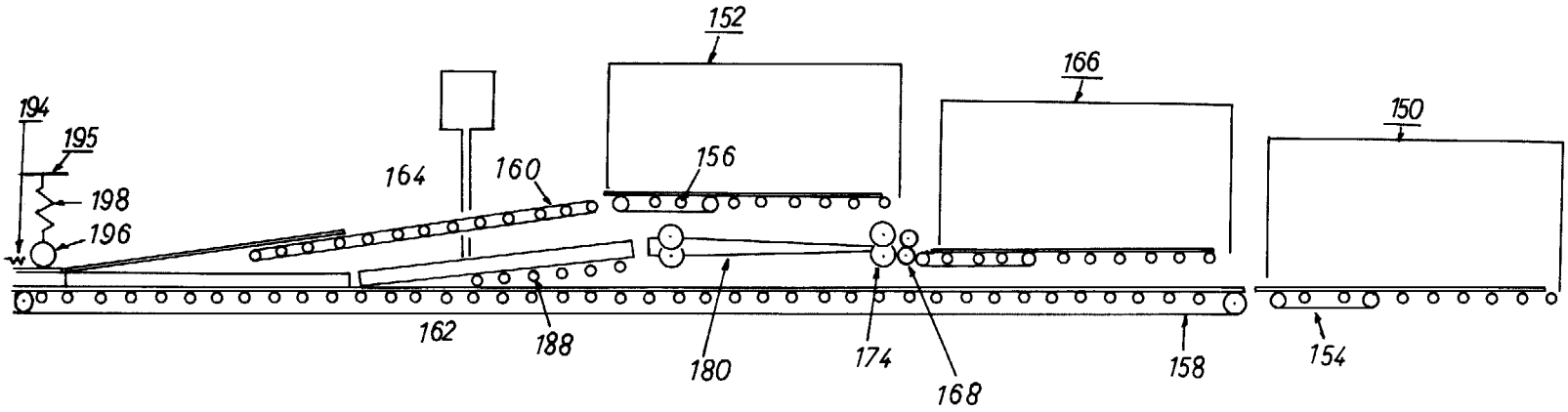
FIGS. 5 and 6 are diagrammatic representations illustrating a step by step construction of the wall by a method according to a preferred embodiment of the invention, FIG. 5 being a side view and FIG. 6 a top view.
Figure 7:
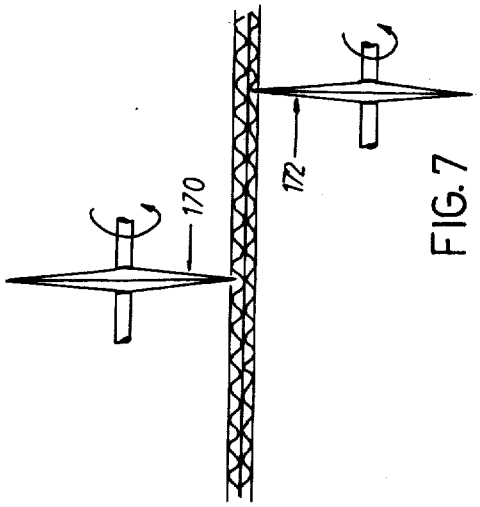
FIGS. 7, 8 and 9 are close-up representations of specific steps of the method of the manufacture illustrated in FIGS. 5 and 6.
Figure 8:
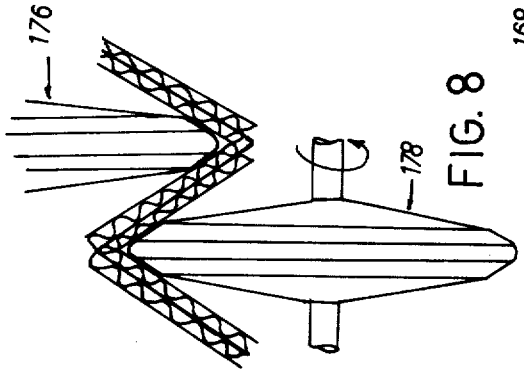
Figure 6:
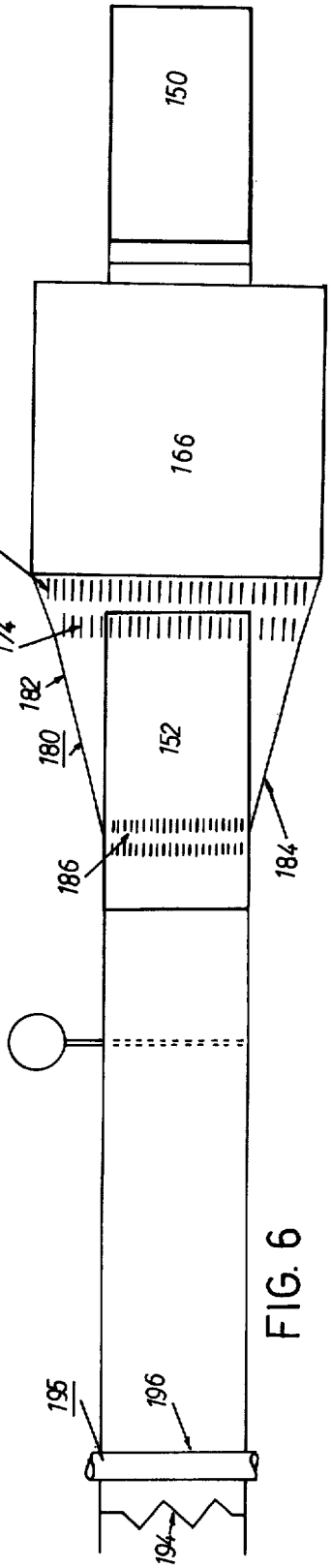

A method of manufacture of the structural members has also been provided according to a preferred embodiment of the invention. A diagrammatic or schematic is provided in FIGS. 5 and 6 of the steps of manufacture together with close-ups of portions of apparatus used in their manufacture in FIGS. 7, 8 and 9. It is of course to be understood that the components of the apparatus suitable for carrying out the method are known in the art and thus form no part of the invention. Therefore, a schematic of the required steps illustrating apparatus by its function is provided. Where it has been deemed necessary to do so, however, close-ups of portions of the apparatus have been provided.

According to the invention bins 150 and 152 are provided into which dry wall panels are stacked. The panels are then fed one at a time from the base of the bin by belts 154 and 156 respectively to conveyor belts 158 and 160 where they are moved to positions 162 and 164 for the purposes hereinafter described.

Bin 166 stores sheets of triple faced double corrugated cardboard. Single sheets are taken therefrom one at a time and fed through a series of parallel longitudinally extending cutting knives 168 which are alternately disposed to contact the sheet to be fed therebetween, above and below same, to make alternate longitudinal cuts on the upper and lower surfaces thereof. For example, cutting knives 170 and 172 shown in FIG. 7 will cut the cardboard on opposite sides so that alternate cuts are provided in the material in the upper and lower surfaces. The cut board is next fed into a plurality of longitudinally disposed substantially parallel driven folding wheels 174, each cutting knife having a corresponding folding wheel to contact the side of the cardboard opposite the side in which the cut was made. Each wheel is pushed into the cardboard to fold the material towards the cut to assist in the corrugation of the material. Thus wheels 176 and 178 shown in FIG. 8 push into the cardboard on the side opposite the side in which the cut was made, each wheel being in the same longitudinal vertical plane as knives 172 and 170 respectively. The folded material is then forced through a converging guide 180 having tapered side walls 182 and 184 in the direction away from the cutting knives 168 to further fold the board. As the folded board exits from guide 180, it enters a second set of folding wheels 186, similar to those in FIG. 8 but of a construction and disposition to provide a deeper fold.

Figure 9:
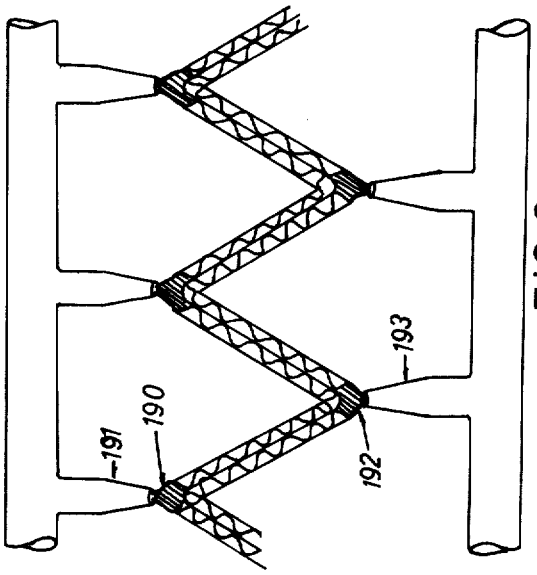

The folded board is then moved by rollers 188 to a position vertically intermediate positions 162 and 164 whereat a bonding agent is applied to the cuts in the sheet on both the top and bottom, see FIG. 9, at 190 and 192, by nipples 191 and 193 respectively and the sheets of dry wall, moved to positions 164 and 162 above and below the corrugated sheet applied so that the outer peripheral edges of the corrugated cardboard core lie within the peripheral extent of the boards. The combination then passes through a roller mechanism 195 whereat rollers 196 supported by spring members 198, exert inward pressure to compress the members for a satisfactory and durable adhesion, and then through a heating device 194 to assist the bonding agent to adhere both to the dry wall and cardboard. After drying, the structural members are ready for shipment.

It will be understood that since the invention does not reside in the individual components used to carry out the above method which are individually well known in the art they have not been shown in their entirety. Only where it was deemed necessary to do so, are portions of the apparatus shown and only schematically for purposes of representation. Furthermore, since the structural members and their supports can be manufactured otherwise without departing from the scope of the invention, it is intended that the above description be illustrative only and not in a limiting sense.

The embodiments of the invention in which an exclusive property or privilege is claimed are as follows:

1. The combination of an inverted U-channel ceiling member for mounting a structural member and first and second floor mounting components, said structural member comprising two sheets of material sandwiching a corrugated core between a floor and ceiling, the structural member being shorter than the distance between the floor and ceiling, said first component being adapted to be affixed to the floor, said first and second components each comprising a generally horizontally disposed component, each having inner and outer ends, and a generally vertically disposed component attached at the outer end of each horizontal component for engagement with an outer surface of the structural member when said components are used to mount the structural member, support means secured to each horizontally disposed component for supporting the structural member, said support means comprising a crimp disposed a predetermined distance along each horizontal component from the juncture of the horizontal component and the generally vertical component, and means on the inner end of the horizontal component of each of the components to be inter-engaged to secure the structural member, said last means comprising, resilient means on said first component, forming an obtuse angle with the horizontal component when the structural member has not been mounted thereon, but deflected downwardly when the structural member has been mounted thereon, and engaging means on the second component, to underlie the resilient means when said resilient means is deflected downwardly by the structural member, thereby locking said second component and thus said structural member against movement until the structural member is lifted causing the resilient means to spring upwardly towards its initial position, thereby permitting the second component and thus the structural member, to be easily removed, the distance between the crimps when the resilient means of the first component overlies the engaging means of the second component, being equal to the thickness of the structural member so that the outer surfaces of the structural member abut the crimps.

2. The combination of claim 1 wherein said resilient means includes teeth on the underside for seating in a plurality of cavities on the upper surface of the engaging means of the second component, when said resilient means is deflected downwardly by the structural member when the first and second components are used to mount the structural member.

3. The combination of claim 1, in which said resilient means comprises resilient ramp means sloping upwardly away from the crimp in the first component and said engaging means on said second component slopes upwardly towards the crimp on the second component for locking the structural member when said first and second components are used to mount the structural member until the structural member is raised, whereby the resilient ramp means of the first component springs upwardly to permit the ramp means of the second component to be dislodged from under the ramp means of the first component and permit removal of the structural member.

4. The combination of an inverted U-channel ceiling member for mounting a structural member between a floor and ceiling and a structural member said structural member comprising two sheets of material sandwiching a corrugated core and being shorter than the distance between the floor and ceiling, said combination further including first and second floor mounting components, said first component being adapted to be fixed to the floor, and comprising a generally vertically disposed portion and a resilient horizontally disposed portion attached thereto, when the structural member is mounted, a crimp in the horizontally disposed portion adjacent the juncture of the vertical and horizontal portions and resilient means adjacent the end of the horizontal portion remote the vertical portion, normally forming an obtuse angle with the horizontal portion to be deflected downwardly when the structural member is mounted, said second component comprising a generally vertically disposed portion and horizontally disposed portion attached thereto, a crimp in the horizontally disposed portion adjacent the juncture of the vertical and horizontal portion and engaging means adjacent the end of the horizontal component remote said vertical portion to underlie the resilient means of the first component and co-act therewith when the structural member is secured into position by said first and second components, depressing said resilient means into locking engagement with said engaging means on said second component, the crimp and engaging means of the horizontal component of the second component when the member is mounted being at least as wide as the thickness of the other sheet of material, and the distance between the crimps when said structural member is secured by the first and second components being substantially the thickness of the said structural member, the distance between the crimp and the resilient means when the member is mounted being of a width of at least as wide as the thickness of one of the sheets of material of the structural member.

5. The combination of claim 4, in which said resilient means comprises resilient ramp means sloping upwardly away from the crimp in the first component and said engaging means on said second component slopes upwardly towards the crimp on the second component for locking the structural member when said first and second components are used to mount the structural member until the structural member is raised, whereby the resilient ramp means of the first component springs upwardly to permit the ramp means of the second component to be dislodged from under the ramp means of the first component and permit removal of the structural member.

6. The combination of claim 4 wherein the said corrugated core does not extend to the periphery of the structural members at least one side thereof.

7. The combination of claim 4, wherein said corrugated core in transverse section, comprises a series of "V'S" attached at their upper ends when the structural member is mounted and the sheets of material comprise dry-wall.

* * * * *